US005190350A

United States Patent [19]

Hwang et al.

[11] Patent Number: 5,190,350

[45] Date of Patent: Mar. 2, 1993

[54] SEATING ARRANGEMENT

[75] Inventors: Phillip Hwang; Lisa Hwang, both of Taipei, Taiwan

[73] Assignee: Goodway Corporation, Taipei, Taiwan

[21] Appl. No.: 567,369

[22] Filed: Aug. 14, 1990

Related U.S. Application Data

[63] Continuation-in-part of Ser. No. 406,745, Sep. 13, 1989, Pat. No. Des. 329,148.

[51] Int. Cl.[5] ..... B60N 2/02

[52] U.S. Cl. ..... 297/380; 297/DIG. 1; 297/456; 297/226; 297/DIG. 3

[58] Field of Search ..... 297/380, 460, DIG. 1, 297/DIG. 3, 218, 226, 229, 378, 441, 456, 17, 353, 53, 54; 5/450, 449

[56] References Cited

U.S. PATENT DOCUMENTS

| | | | |
|---|---|---|---|
| 1,218,291 | 3/1917 | Meinecke | 5/450 |
| 1,343,357 | 6/1920 | Eggers | 5/449 |
| 2,623,574 | 12/1952 | Damsch | 297/380 |
| 3,093,407 | 6/1963 | Wilson | 297/460 |
| 3,611,455 | 10/1971 | Gottfried | 5/450 |
| 3,872,525 | 3/1975 | Lea et al. | 5/450 |
| 4,039,363 | 8/1977 | Robertson | 297/DIG. 1 |
| 4,518,203 | 5/1985 | White | 297/380 |
| 4,899,406 | 2/1990 | Sanderson et al. | 297/DIG. 3 |

FOREIGN PATENT DOCUMENTS

| | | | |
|---|---|---|---|
| 491990 | of 1938 | United Kingdom | 297/380 |

*Primary Examiner*—Kenneth J. Dorner
*Assistant Examiner*—Milton Nelson, Jr.
*Attorney, Agent, or Firm*—Ladas & Parry

[57] ABSTRACT

A lightweight seating arrangement having an envelope with an upper layer and a lower layer defining a pad-receiving, air-tight cavity. A pad is positioned within the cavity and preferrably bonded to the upper layer and lower layer. The pad folds along a fold line from a flat position to a position in which a back portion extends upwardly from the seat portion and the back portion is movable towards and away from the seat portion along the fold line. The pad may be comprised of two parts, one in the seat portion and one in the back portion, with a space therebetween to provide the fold line. Flaps extending completely across the seating arrangement are provided at the remote ends thereof and overly a portion of both the back portion and the seat portion. Tab portions are coupled to the flaps at the sides thereof and flexible straps, which are detachably coupled together, are provided on the tab portions. When the flexible straps are coupled together, the back portion may be retained in any desired angular orientation with respect to the seat portion as desired. A valve is provided for allowing air into and out of the air-tight cavity and for sealing air at atmospheric pressure, greater than atmospheric pressure, or lower than atmospheric pressure, as desired.

16 Claims, 4 Drawing Sheets

FIG. 3
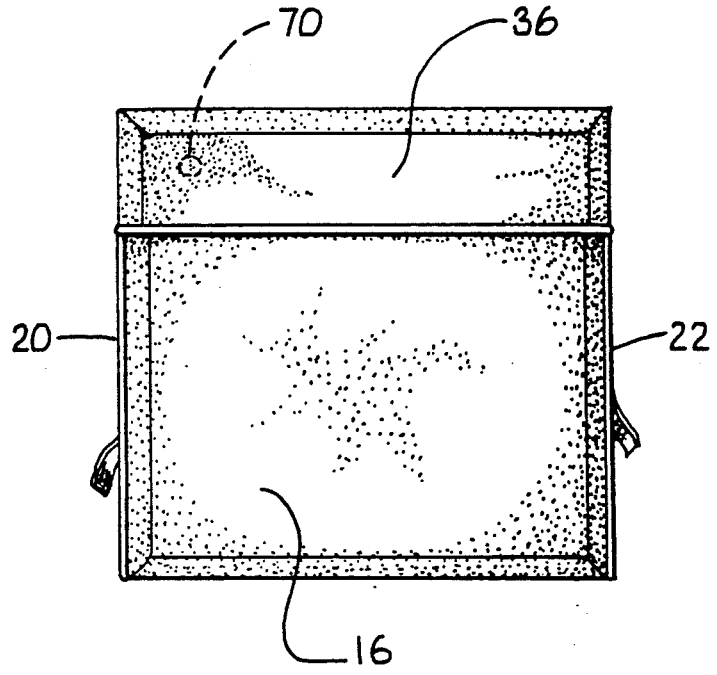
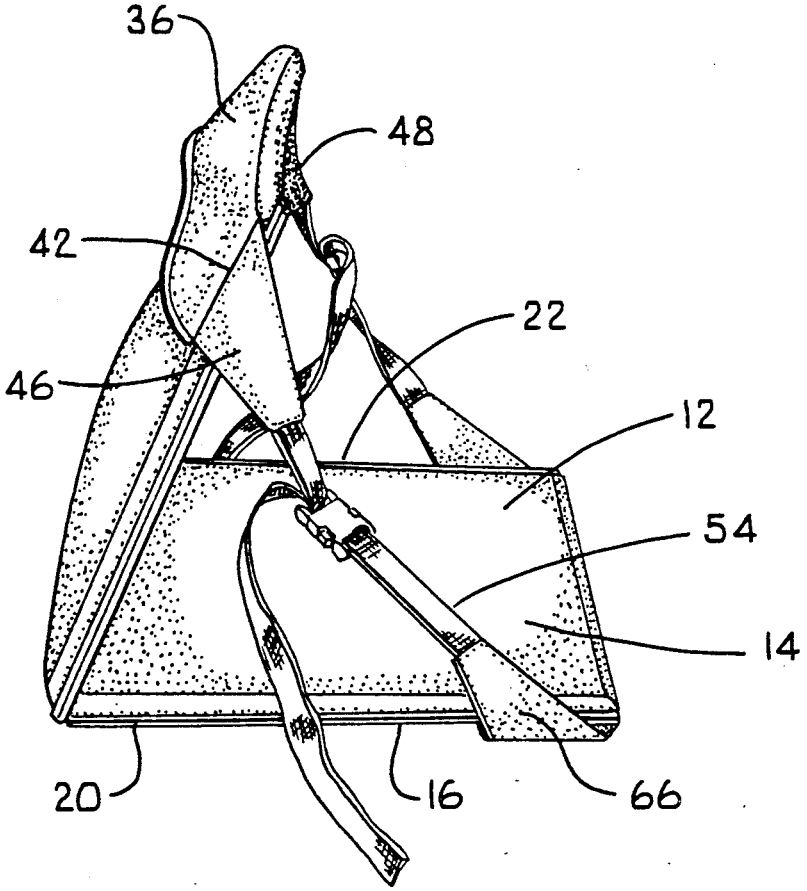
FIG. 4

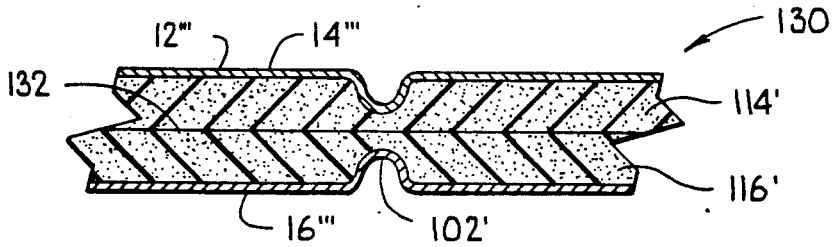
FIG. 9
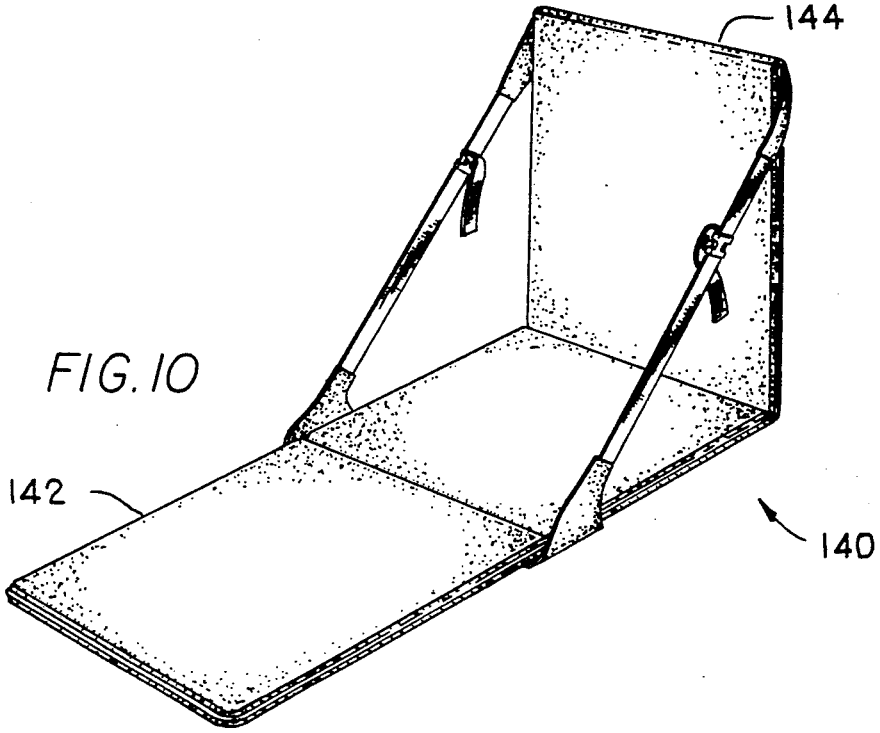
FIG. 10
FIG. 11
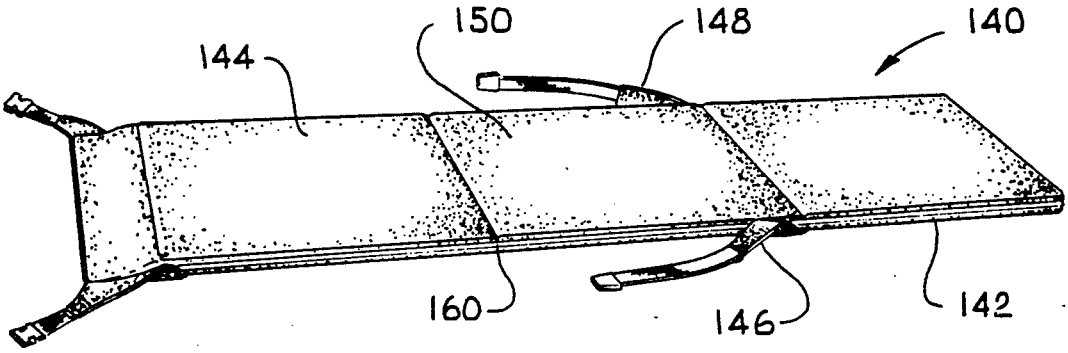

SEATING ARRANGEMENT

REFERENCE TO RELATED APPLICATION

This Application is a continuance-in-part of Design Patent application Ser. No. 406,745, filed Sep. 13, 1989, and patented (D329148) on Sep. 8, 1992.

BACKGROUND OF THE INVENTION

1. Field of the Invention

This invention relates to the seating art and, more particularly to an improved portable seating arrangement particularly useful in various outdoor activities ranging from backpacking, camping, mountain climbing and the like, to comfortable seating at stadiums or other locations where more comfort in seating is desired than is provided.

2. Description of the Prior Art

Various types of portable seating arrangements have heretofore been made available. One such application for portable seating arrangements is in the mountain climbing, backpacking, and generally outdoor activity fields. As such, such portable seating arrangements are preferably comparatively lightweight and are flexible so that they may be readily folded or rolled into a comparatively compact arrangement. One such portable seating arrangement heretofore available had a flexible cover having a lower layer and an upper layer. The lower layer was continuous from one end to the other. The upper portion was divided along a central line extending between the peripheral edges and a flexible plastic foam pad was removably insertable through the slit in the upper layer. Such a seating arrangement folded along the slit. Rather, large pockets were provided along the lateral peripheral edges of such a prior art seating arrangement and padded rigid members were insertable into the four pockets extending along the lateral edges from openings aligned with the slit in the upper layer. The pad was not bonded to the cover. At the top and bottom of the seating arrangement above described, flaps extending outwardly from the above-mentioned pockets were provided and straps were coupled to these flaps for detachable coupling together so that the back portion of the seating arrangement could move along a fold line towards and away from the seat portion and be restrained in any desired angular position by the strap means, the fold occurring along the above-mentioned slit in the body.

Such portable seating arrangement has not proven to be completely satisfactory. In addition to relative movement between the pad and the cover surrounding the pad, the cover was not air tight and, therefore, could not be inflated and deflated to provide either a comparatively small volume when deflated or greater resistance to compression when inflated. Additionally, the bulk of the padded rigid members extending on the pockets on the lateral edges of the body prevented convenient rolling of the entire unit into a comparative small configuration. Further, there was no reinforcing along the remote ends extending between the lateral edges and, therefore, there was considerable flexing of the back portion and the seat portion when in use because of the forces imposed thereon. Such bending or flexing detracted from the comfort of the unit when so utilized as a seat.

In other prior art arrangements, mats or pads utilized for backpackers, campers, or the like for sleeping have incorporated an open-cell foam inside a body member having an upper layer and a lower layer and the closed-cell foam bonded throughout its extent to the upper layer and lower layer of the body member. Such sleeping pads have also been provided with an air valve to allow air to selectively enter and leave the cavity containing the open-cell foam pad. However, such pads have not been provided with a fold line to allow folding of the pad into a configuration having a back and a seat.

Therefore, there has long been a need for a portable, flexible lightweight seating arrangement that can provide various resistance to the forces imposed thereon, that has an air-tight cavity for retaining a pad and which cavity may be inflated and deflated as desired.

Additionally, it has long been desired to provide a seating arrangement of the type above described in which reinforcing is provided along the remote ends of the seating arrangement at both the back and the seat portions to prevent excessive bending or flexing when in use.

SUMMARY OF THE INVENTION

Accordingly, it is an objective of the present invention to provide an improved portable seating arrangement.

It is another of the present invention to provide an improved portable seating arrangement in which a body means has an air-tight pad receiving cavity in which a pad is received and the cavity may be inflated and deflated with air to increase and decrease the resistance to forces imposed thereon.

It is yet another object of the present invention to provide an improved seating arrangement in which comparatively small, rigid removable reinforcing members are provided adjacent the lateral edges to provide enhanced stability of the unit in use.

The above and other objects of the present invention are achieved, according to a preferred embodiment thereof, by providing a flexible air-tight body means having an upper layer, a lower layer, and spaced apart remote ends and spaced apart lateral edges extending between the remote ends. The air-tight body means defines an air-tight pad means receiving cavity between the upper and lower layers. The body means is moveable from a flat position wherein the entire seating arrangement is substantially planar to a seating position wherein a back portion extends at a predetermined angle from the seat portion and is restrained at such predetermined angle. Such angle may be, for example, on the order of 90°, more than 90°, or less than 90°, depending upon the particular angle providing the most comfort for the user thereof.

In order to provide the resistance to flexing along the remote ends of the seating arrangement, in this embodiment of the present invention, a pair of flexible flap means are coupled to the body means, one at the first remote end and the other at the second remote end and each flap means extends between the lateral edges. The flap means has a preselected distance between an inner end that is coupled to the body means and an outer end so that the flap means, when the seating arrangement is in the seating position, may overlie regions adjacent the remote ends of the body means. The flap means has tab portions extending outwardly from the flap means and flexible strap means are coupled to the tab portions for detachable coupling together to restrain the seating arrangement in the desired seating position.

Means are provided to define a fold line along which the seating arrangement folds to move the back portion and seat portion relative to each other between the flat position to the seating position. In one preferred embodiment of the present invention the fold line is provided by dividing the pad means which is inserted in the pad means receiving cavity of the body means into two portions: a back portion and a seat portion. A space is left between the back portion and seat portion of the pad means, and the space extends between the lateral edges along the fold line and this region free of the pad means defines the fold line. The two layers of the body means which define the pad means receiving cavity are not coupled to each other in this fold line region.

In another embodiment of the present invention, the fold line is provided by heating and partially collapsing the pad means along the desired fold line but not collapsing the pad means completely in order that there may be air flow continuously between the seat portion and the back portion.

In preferred embodiments of the present invention the flap means and the tab portions are provided by extensions of the upper and lower layers of the body means which define the pad means receiving cavity, and are bonded to each other. However, it will be appreciated that, in some applications, for economy of manufacture, just the flap means, without the tab portions, may be so comprised of the upper and lower portions of the body means bonded to each other and the tab portions may comprise separate pieces sewn or otherwise secured to the flap mean since the tab portions extend outwardly from the flap means.

Strap means are coupled to the flap means for detachable coupling together and such strap means provide a means for restraining the seating arrangement in the seating position. In the seating position, with the flap means overlying the remote end portions of the seat portion and back portion, the forces transmitted are distributed along the entire width between the lateral edges of the body means in the area of overlap between the flap means and the body means and, thus, the flexing or bending of the body means is minimized to provide the additional comfort desired.

A valve means of conventional design may be provided in the body means communicating with the pad means receiving cavity. The valve has an open position in which air is free to flow into and out of the pad means receiving cavity of the body means and a closed position wherein the flow of air is prevented from entering or leaving the pad means receiving cavity of the body means.

In another embodiment of the present invention, the seat portion may be extended to a length greater than the back portion so that, in the flat position, the seating arrangement may serve additionally as a sleeping pad. In such an embodiment, the tabs utilized for attaching the straps adjacent to the seating portion may be intermediate the fold line and the remote end of the seat portion because of its extra length and the flap means may be eliminated from such an arrangement, if desired. Further, it will be appreciated that in other embodiments of the present invention the flap means may be eliminated from the seat portion according to the principals of the present invention regardless of the length of the seat portion if additional support is not needed along the remote end of the seat portion.

Pocket means may be provided along the lateral edges in which comparatively small reinforcing rods may be detachably inserted to provide rigidity to the lateral edges in both the seat portion and back portion.

BRIEF DESCRIPTION OF THE DRAWINGS

The above and other embodiments of the present invention may be more fully understood from the following detailed description taken together with the accompanied drawings wherein similar reference characters refer to similar elements throughout and in which:

FIG. 3 is a back-elevational view of the embodiment shown in FIG. 1 in the seating position thereof;

FIG. 4 is a side perspective view of the seating arrangement illustrated in FIG. 1;

FIG. 9 is a partial sectional view of another embodiment of the present invention;

FIG. 10 is a perspective view of another embodiment of the present invention in the seating position thereof; and FIG. 11 is a perspective view of the embodiment shown in FIG. 10 in a flat position thereof.

DESCRIPTION OF THE PREFERRED EMBODIMENTS

Figure 1:
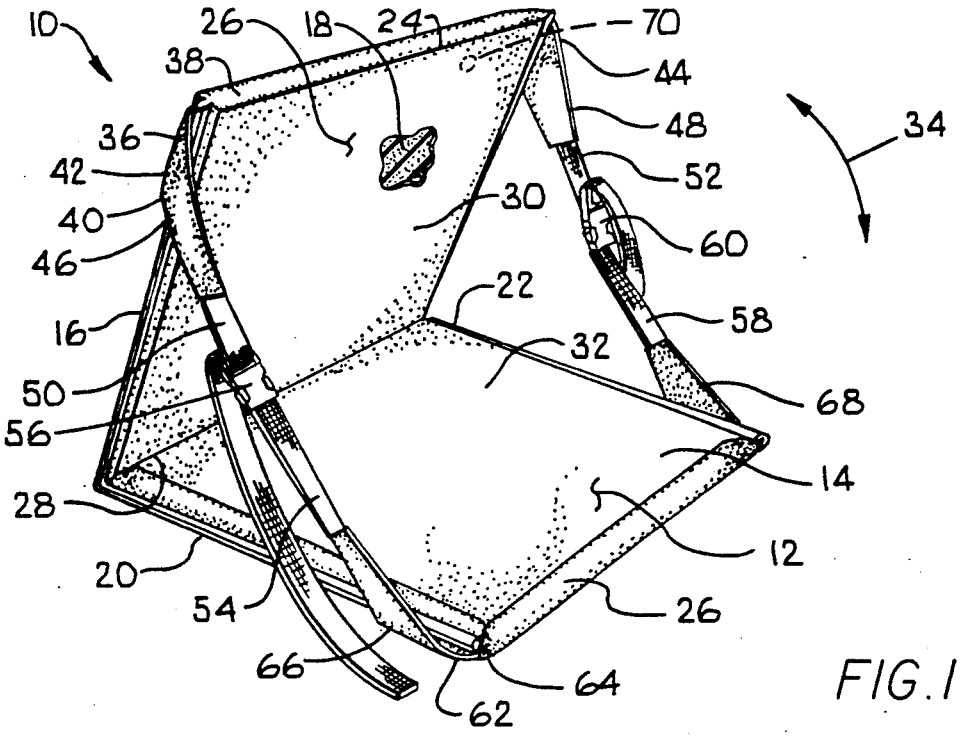
FIG. 1 is a perspective view of a preferred embodiment of the present invention in the seating position thereof.

Referring now to FIGS. 1, 2, 3, and 4, there is illustrated a preferred embodiment of the present invention generally designated 10. The embodiment 10 is generally comprised of a body means 12 having an upper layer 14 and a lower layer 16 which define a air-tight pad means receiving cavity generally designed 18 between the upper layer 14 and lower layer 16. The upper layer 14 and lower layer 16 are coupled to each other around the periphery of the pad means accepting cavity 18 and define a pair of spaced apart lateral peripheral edges generally designated 20 and 22, a first end peripheral edge 24 and a second end peripheral edge 24' spaced apart from the first end peripheral edge 24.

A pad means generally designated 26 is located in the pad means receiving cavity 18.

Means are provided for providing a fold line generally indicated at 28 extending between the lateral peripheral edges 20 and 22 and intermediate the first end peripheral edge 24 and second end peripheral edge 24'. The fold line 28 divides the body means 12, as well as the pad means 26, into a back portion generally designated 30 and a seat portion generally designated 32. The back portion 30 and seat portion 32 are moveable towards and away from each other about the fold line 28 in the directions indicated by the double-ended arrow 34.

A first flexible flap means generally designated 36 extends between the pair of lateral peripheral edges 20 and 22 and has an inner edge generally designated 38 coupled to the first end peripheral edge 24 and an outer end generally designated 40 spaced a preselected distance from the inner edge 38 and first and second side edges generally designated 42 and 44 extending between the inner edge 38 and outer end 40 and adjacent the lateral edges 20 and 22 of the body member 12. The first flexible flap means is provided with a first flexible tab portion generally designated 46 and a second flexible tab portion generally designated 48. The first flexible tab portion 46 and second flexible tab portion 48 may be of unitary construction with the first flexible flap means 36 or may be separate structures secured to the first flexible flap means 36. The first flexible tab means 46 has a first strap means generally designated 50 coupled thereto and the second flexible tab means 48 has a second strap means generally designated 52 coupled thereto. The strap means 50 and 52 may be coupled by bonding, sewing, or any other desired type of adhering that may be utilized in any particular desired application.

A third flexible strap means generally designated 54 is provided for detachable coupling by means of a buckle 56 to the first flexible strap means 50. It will be appreciated, however, that any other type of detachable coupling between the first flexible strap means 50 and second flexible strap means 54 may be provided as desired, such as hook-and-loop type of engagement or the like. Similarly, a fourth flexible strap means generally designated 58 is detachably coupled by means of a buckle 60 to the second flexible strap means 52 and, similarly, any desired type of detachable securing such as hook-and-loop can be provided for coupling the second flexible strap means 52 to the fourth flexible strap means 58. When so detachably coupled together, the strap means 50, 52, 54, and 58 provide a means for securing the back portion 30 to the seat portion 32 in the seating position of the seating arrangement 10 as illustrated in FIG. 1. The angle between the back portion 30 and seat portion 32 may be 90°, more than 90°, or less than 90°, as desired for comfort for the person utilizing the seating arrangement 10.

In the embodiment 10 illustrated in FIG. 1, attachment means are provided for coupling the third strap means 54 and fourth strap means 58 to the body means 12. In the embodiment 10, the attachment means generally designated 62 is provided by a second flexible flap means generally designated 64 coupled to the second end peripheral edge 24' in a manner similar to the first flap means 36 attachment to the first peripheral edge. Similarly, a third tab portion 66 and fourth tab portion 68 may be provided which are similar to the first tab portion 46 and second tab portion 48 as above described.

Figure 2:
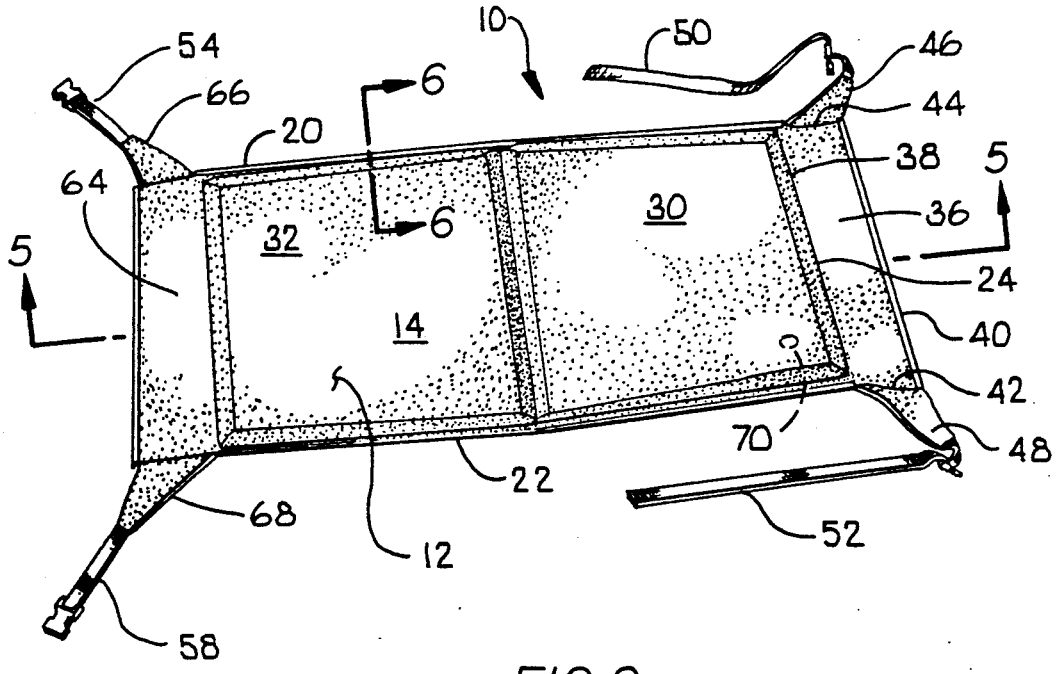
FIG. 2 is a perspective view of the embodiment illustrated in FIG. 1 in the flat position thereof.

FIG. 2 illustrates the embodiment 10 in its flat position thereof. The flat position is achieved when the first, second, third, and fourth flexible strap means 50, 52, 54, and 58, respectively, are detached.

A valve means generally indicated at 70 extends through the lower layer 16 of the body means 12 and into the pad receiving cavity 18. A valve means 70 may be of conventional design and has an open position in which air may flow through the valve means 70 into the pad receiving cavity 18 and out of the pad receiving cavity 18 and a closed position in which air is prevented from entering or leaving the pad receiving cavity 18. Thus, when it is desired to "roll up" the seating arrangement of the embodiment 10, the valve 70 may be opened, the air evacuated therefrom as the pad is rolled, and, thus, provides a smaller volume for storage and carring. When it is desired to utilized the seating arrangement of the embodiment 10, the valve may be opened and atmospheric air allowed to enter into the body of the pad receiving cavity 18. Additionally, if desired, air may be blown into the pad receiving cavity 18 through the valve 70 to thus inflate the pad receiving cavity 18 to a pressure in excess of atmospheric pressure for greater firmness of the seating arrangement 10 as may be desired for particular applications.

Figure 5:
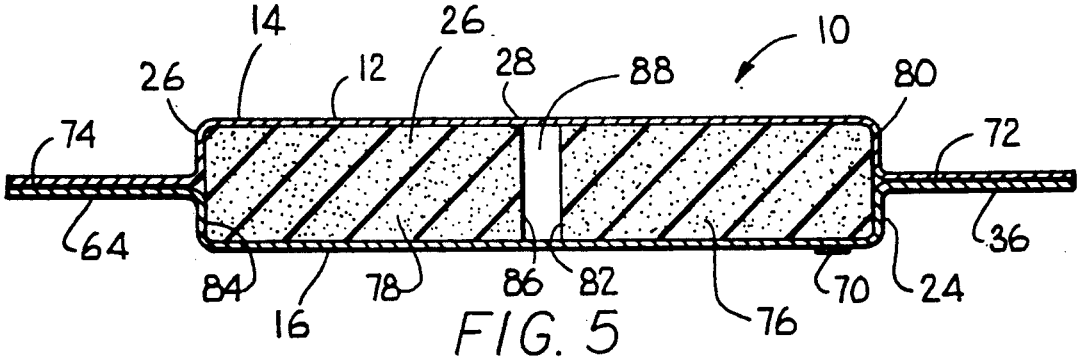
FIG. 5 is a sectional view along the line 5—5 of FIG. 2.

Referring now to FIG. 5, there is illustrated a sectional view taken along the line 5—5 of FIG. 2. As shown in FIG. 5, the lower surface 16 and upper surface 14 of the body means 12 are, in preferred embodiments of the present invention, bonded to the pad means generally designated 26 throughout the extent of the upper layer 14 and lower layer 16. Similarly, the first flexible flap means 36 is comprised of extensions of the upper layer 14 and lower layer 16 bonded to each other as indicated at 72. Similarly, though not shown in FIG. 6, the first and second tab portions 46 and 48 may be comprised of extensions of the upper layer 14 and lower layer 16 extending from the portions thereof forming the first flap means 36. However, for economy of manufacture, it may be desired in certain applications to have the first, second, third, and fourth tab means, as above described, fabricated from separate materials and then sewn, bonded, or otherwise secured to the first and second flap means to provide the attachment for the flexible strap means as above described. Similiarly, the second flexible flap means 64 may also be comprised of extensions of the upper layer 14 and lower layer 16 bonded together as indicated at 74.

In the embodiment as illustrated in FIG. 5, the pad means 26 is comprised of a back portion 76 and a seat portion 78. The back portion 76 has a remote end 80 adjacent the first end peripheral edge 24 and an inner edge 82 spaced from the edge 80. Similiarly, the seat portion 78 has a remote edge 84 adjacent the second end peripheral edge 26 and an inner edge 86 spaced therefrom. The inner edges 82 and 86 in the embodiment 10 are spaced from each other to leave a portion generally designated 88 extending between the peripheral edges 20 and 22 free of the pad means 26. The space 88 provides the fold line 28 for the embodiment 10 to allow the folding into the position shown in FIG. 1. In the fabrication of the seating arrangement of the embodiment of FIG. 10, the upper layer 14 is not bonded to the lower layer 16 in the space 88. Further, the pad means 26 comprised of the back portion 76 and seat portion 78 in the embodiment 10 is comprised of an open-cell foam. In preferred embodiments of the present invention, the open-cell foam of the pad means 26 has a density on the order of 1.4 to 1.7 pounds per cubic foot. However, it will be appreciated, densities higher or lower than such values may be utilized as desired for particular applications. The pad means 26 is preferrably a flexible open-cell polyurethane foam. The body means 12 may be comprised of a nylon outer layer and a suitable thermoplastic or thermosetting inner layer or a plurality of such layers for bonding the pad means 26 to the body means 12 and for allowing the bonding of the upper layer 12 to the lower layer 16 in the region, for example, at 74 and 76.

The inner edges 82 and 86 of the pad portion **76*a* in the back portion 76 and pad portion 78*a* of the seat portion 78, respectively, defining the space 88** are spaced apart by a dimension on the order of ¼ inch to 1½ inches in preferred embodiments of the present invention.

Figure 6:
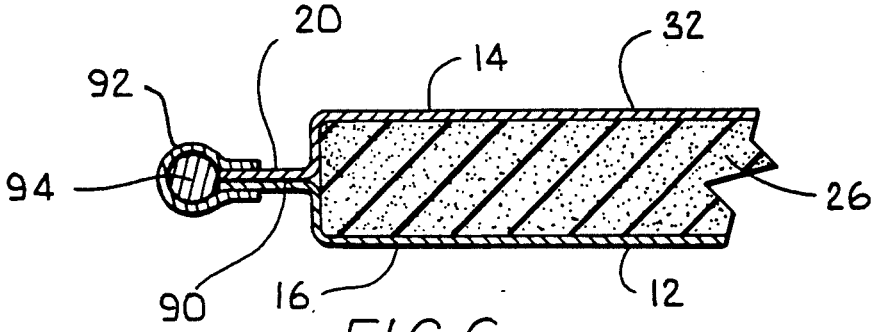
FIG. 6 is a sectional view along the line 6—6 of FIG. 2.

In order to provide greater stability to the seating arrangement 10 when in the seating position as indicated in FIG. 1, it is preferred that there be rigid stiffening means preferably removeably insertable along the peripheral edges 20 and 22 in both the back portion 30 and seat portion 32. FIG. 6 is a sectional view along the line 6—6 of FIG. 2 and illustrates a preferred arrangement for the provisions of the stiffening means. As illustrated in FIG. 6, the upper layer 14 and lower layer 16 are bonded together along the peripheral edge 20 as indicated at 90. A pocket means generally designated 92 is provided and may be a cloth, plastic, or any other desired material into which a rigid member generally designated 94 may be removably inserted. The rigid member 94 may be a nylon rod or the like. The rigid member 94 is preferrably removable from the pocket means 92 to provide for more convenient rolling and storage of the seating arrangement 10 in both directions of its extent.

The overall thickness of the pad means 26 may be in the range of ½ to 2 inches though, of course, greater or smaller values may be utilized as desired for particular applications.

Figure 7:
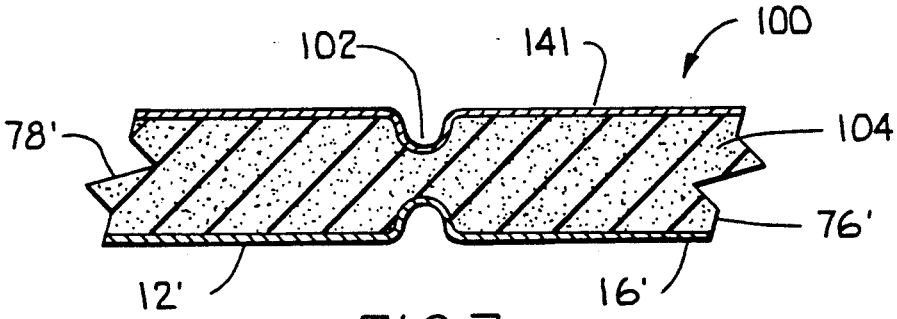
FIG. 7 is a partial sectional view of another embodiment of the present invention.

FIG. 7 illustrates another embodiment of the present invention generally designated 100 and, in particular, is a sectional view showing another structural arrangement for providing a fold line generally illustrated at 102. In the embodiment 100, there is an upper layer generally designated 14' and a lower layer generally designated 16' of a body member generally designated 12' which is similar to the body member 12 described above. The pad means 104 is an open-cell foam which may have the same physical characteristics as the pad means 26 described above except that it is continuous between the back portion 76' and seat portion 78'. The fold line 102 is provided by partially collapsing the pad means 104 along a line extending between the lateral edges 20 and 22 (not shown in FIG. 7) generally in the same position as that shown for the space 88 of FIG. 5. Care must be taken in such an embodiment that when the fold line 102 is formed that the pad means 104 extending there along not be collapsed completely since such would prevent the flow of air between the seat portion 78 and back portion 76 as desired for inflation and deflation thereof.

Figure 8:
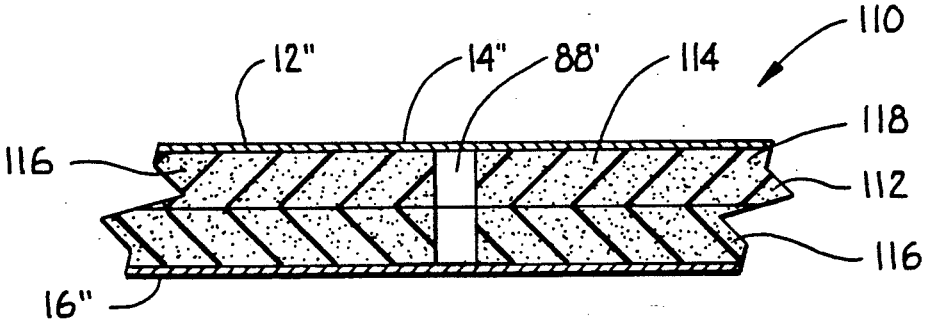
FIG. 8 is a partial sectional view of another embodiment of the present invention.

FIG. 8 illustrates another embodiment of the present invention generally designated 110 in which there is provided a body member 12'' having an upper layer 14'' and a lower layer 16''. The pad means generally designated 112 is comprised of two layers: a first open-cell foam layer generally designated 114 which may have the same density pad means 26 described above and be comprised of an open-cell foam. However, it is preferably only half of the thickness of the pad means 26 described above.

A second pad means layer 116 is provided substantially coextensive with the first layer 114 and the pad layer 116 may be a close-cell foam and, if desired, extend in the space 88' between the seat portion of the pad means 114 generally designated 116 and the back portion thereof generally 118. Thus, the layer 116 may be separated into the two separate portion similar to the two portions of the pad means 118 or it may be continuous through the space 88'.

FIG. 9 illustrate another embodiment of the present invention generally designated 13 which is similar to the embodiment shown in FIG. 7 except that it incorporates two continuous pad layers. The first pad layer 114' may be an open-cell foam layer similar to the layer 114 but continuous, that is, without any space 88', and the second layer 116' may be a closed-cell foam and also continuous. The fold like 102' is provided by partially collapsing at least the first pad layer 114' but still allowing a portion thereof to communicate through the fold line so that communication and air-flow between the sections may be provided as described above. The closed-cell layer 116' may be totally collapsed down to the interface 132 or partially collapsed as illustrated in FIG. 9 since air flow between the sections does not occur with the close-cell foam.

FIGS. 10 and 11 illustrate another embodiment of the present invention generally designated 140. The construction of the embodiment 140 may be generally similar to any of the constructions of the embodiments described above except that the seat portion generally designated 142 is elongated to be a length greater than the back portion 144. In the flat position thereof, as illustrated in FIG. 11, therefore, the seating arrangement 140 may be utilized as a sleeping pad or mat as well as a seating arrangement, as illustrated in FIG. 10.

In the embodiment 140, it may not be necessary to extend the second flexible flap means between the lateral edges thereof. Thus, the third and fourth tab means 146 and 148 may be comprised of extensions of the upper layer generally designated 150 and lower layer generally designated 160 bonded together as described above or, alternatively, they may be separate portions sewn or otherwise secured to the peripheral edges. It will be appreciated, of course, that even in the embodiment 10 shown on FIG. 1 it may sometimes be desirable to eliminate the second flexible flap means and just provide the tab portions coupled to the peripheral edges.

It will be appreciated that the flap portions, by overlying the top of the back portion and the seat portion as may be desired, provides a distribution of the forces imposed thereon by a person utilizing the seating arrangement and leaning back against the back portion and/or on the seat portion and the straps transmitting the forces therebetween. Such forces by being distributed over the wide area covered by the overlying portion as illustrated, for example, in FIG. 4, provides resistance to excessive flexing or bending of the pad means and greater comfort to the user.

This concludes the description of the preferred embodiments of the present invention. It will be appreciated that the embodiments described above are not intended to be limiting to the invention and all embodiments falling within the true scope and spirit of the appended Claims are intended to be covered thereby.

What is claimed:

1. An improved portable seating arrangement comprising, in combination:

a flexible, air tight body means defining an air-tight pad means receiving cavity and having spaced remote end edges and spaced apart lateral edges extending between said spaced apart end edges, and said body means having a fold line extending between said lateral edges and intermediate said remote end edges to define a seat portion extending from said fold line to one of said remote end edges and a back portion extending from said fold line to the other of said remote end edges and said back portion and said seat portion movable towards and away from each other along said fold line;

a flexible pad means in said pad means receiving cavity;

a pair of substantially flexible flap means coupled to said body means, and one of said flexible flap means at each of and extending from said remote end edges of said body means, and said flexible flap means extending between said lateral edges and each of said flexible flap means positionable to overly and to be in contact with a portion of said body means in regions adjacent said remote end edges thereof and said flexible flap means extending from said end edges a preselected distance toward said fold line and extending between said lateral edges, for said seating arrangement in the seating position thereof whereby said flexible flap means resists forces imposed on said body means to distribute such resistance to forces across the width of said body means;

strap means coupled to said pair of flexible flap means for detachable coupling together to restrain said body means in said seating position thereof; and means for providing said fold line between said back portion and said seat portion.

2. The arrangement defined in claim 1 and further comprising valve means for selectively permitting and preventing air flow into and out of said pad means receiving cavity of said body means.

3. The arrangement defined in claim 1 and further comprising rigid rod means removably mounted in said body means adjacent said spaced apart lateral edges of said body means.

4. The arrangement defined in claim 1 wherein said pair of flexible flap means comprise extensions of said body means extending outwardly from said remote ends of said body means.

5. The arrangement defined in claim 1 wherein said fold line is provided by a partially collapsed portion of said pad means.

6. The arrangement defined in claim 1 wherein said pad means comprises a first layer of open-cell flexible plastic foam material and a second layer substantially coextensive with said first layer of a closed-cell plastic foam material.

7. The arrangement defined in claim 1 wherein:

said fold line is provided by a region extending between said lateral edges of said body means free of said pad means.

8. The arrangement defined in claim 6 wherein each of said first layer and said second layer of said pad means defines a space a long said fold line free of said first layer and of said second layer of said pad means.

9. The arrangement defined in claim 1 wherein said pad means comprises a first pad portion in said back portion of said body means and having a first end adjacent the first of said remote ends of said body means and a second end in regions adjacent said fold line, and a second pad portion in said seat portion of said body means having a first end adjacent said second remote end of said body means and a second end in regions adjacent said fold line and said second end of said second pad portion spaced a preselected distance apart from said second end of said first pad portion.

10. The arrangement defined in claim 9 wherein said preselected spacing between said first pad portion and said second pad portion is in the range of ¼ inch to 1½ inches.

11. The arrangement defined in claim 9 wherein each of said first pad portion and said second pad portion is bonded to said cover means substantially continuously between said fold lines and said remote ends of said body means and said lateral edges of said body means.

12. An improved portable seating arrangement comprising, in combination:

a flexible, air tight body means having an upper layer and a lower layer and defining an air-tight pad means accepting cavity therebetween, said upper layer and said lower layer coupled to each other around the periphery of said pad means accepting cavity and defining a pair of spaced apart lateral peripheral edges, a first end peripheral edge, and a second end peripheral edge spaced apart from said first end peripheral edge;

flexible pad means in said pad means accepting cavity;

fold line defining means for providing a fold line extending between said lateral peripheral edges at a preselected location intermediate said first end peripheral edge and second end peripheral edge of said body means for dividing said body means into a back portion and a seat portion, and said back portion and said seat portion moveable towards and away from each other about said fold line, and said back portion extending from said first end peripheral edge to said fold line and said seat portion extending from said second end peripheral edge to said fold line;

a first flexible flap means extending between said pair of lateral edges and having an inner edge secured to said first end peripheral edge of said body means and an outer end spaced a first preselected distance from said inner edge, and first and second spaced apart side edges extending between said inner edge and said outer end in regions adjacent said pair of lateral peripheral edges of said body means, and said first flexible flap means positionable to overly and to be in contact with a portion of said body means adjacent said first end peripheral edge and said flexible flap means extending a preselected distance toward said fold line and extending between said pair of lateral peripheral edges for said body means in the seating position thereof whereby said flexible flap means resists forces imposed on said body means to distribute such resistance to forces across the width of said body means;

said first flap means having a first flexible tab portion at said first side edge thereof and extending outwardly therefrom, and said first flap means having a second tab portion at said second side edge thereof and extending outwardly therefrom;

first flexible strap means coupled to said first tab portion and second flexible strap means coupled to said second pad portion;

third flexible strap means for detachable coupling to said first strap means;

fourth flexible strap means for detachable coupling to said second flexible strap means;

attachment means for coupling said third and fourth flexible strap means to said body means;

pocket means coupled to said lateral peripheral edges of said body means for receiving ridged reinforcing rod means removably insertable therein;

a plurality of rigid reinforcing rod means removably inserted in said pocket means;

valve means having an open position for selectively allowing air flow into and out of said pad means receiving cavity of said body means and a closed position preventing the flow of air into and out of said pad means receiving cavity of said body means.

13. The arrangement defined in claim 12 wherein said first flap means is comprised of said upper layer and said lower layer of said body means bonded to each other.

14. The arrangement defined in claim 13 wherein:

said pad means comprises a seat portion in said seat portion of said body means and a back portion in said back portion of said body means and said pad means receiving cavity of said body means free of said pad means along said fold line thereof.

15. The arrangement defined in claim 14 wherein said attachment means for coupling said third and fourth flexible strap means comprises a second flexible flap means coupled to said body means in a spaced apart relationship from said first flap means.

16. The arrangement of claim 15 wherein said second flap means is intermediate said first end peripheral edge and said second end peripheral edge, and said seat portion of said body means has a length between said fold line and said second end peripheral edge greater than the length between said fold line and said first end peripheral edge.

* * * * *